US012503301B1

(12) United States Patent
Garramone

(10) Patent No.: US 12,503,301 B1
(45) Date of Patent: Dec. 23, 2025

(54) ANTI-THEFT INTERBOX CONNECTOR (IBC) AND RELATED SECURITY METHODS

(71) Applicant: Michael Garramone, Springtown, TX (US)

(72) Inventor: Michael Garramone, Springtown, TX (US)

( * ) Notice: Subject to any disclaimer, the term of this patent is extended or adjusted under 35 U.S.C. 154(b) by 0 days.

(21) Appl. No.: 19/209,758

(22) Filed: May 15, 2025

(51) Int. Cl.
*B65D 90/00* (2006.01)

(52) U.S. Cl.
CPC ..... *B65D 90/0013* (2013.01); *B65D 90/0026* (2013.01); *B65D 2590/0025* (2013.01)

(58) Field of Classification Search
CPC ..... B65D 2211/00
See application file for complete search history.

(56) References Cited

U.S. PATENT DOCUMENTS

| | | | | |
|---|---|---|---|---|
| 1,675,701 | A | 7/1928 | Cox | |
| 3,321,162 | A | 5/1967 | Connerat | |
| 3,753,272 | A * | 8/1973 | Laidley | B65D 90/0013 24/287 |
| 4,265,184 | A | 5/1981 | Cox | |
| 4,854,791 | A | 8/1989 | Brown | |
| 5,062,752 | A | 11/1991 | Takaguchi | |
| 5,072,845 | A | 12/1991 | Gorgan | |
| 5,531,490 | A * | 7/1996 | Parker | E05C 17/04 292/262 |
| 6,164,862 | A * | 12/2000 | Takaguchi | B65D 90/0013 410/83 |
| 6,364,584 | B1 | 4/2002 | Taylor | |
| 6,378,917 | B1 | 4/2002 | Jones | |
| 6,415,938 | B1 | 7/2002 | Karpisek | |
| 7,988,211 | B2 | 8/2011 | Anderson | |
| D651,500 | S * | 1/2012 | Lancaster | D8/343 |
| 8,240,495 | B2 | 8/2012 | Ronci et al. | |
| 8,627,971 | B2 | 1/2014 | Lancaster | |
| 9,809,358 | B2 * | 11/2017 | Lanigan, Sr. | B65D 90/0013 |
| 11,111,707 | B1 * | 9/2021 | Balli | E05C 19/188 |
| 11,530,558 | B2 * | 12/2022 | Grant | E05C 19/003 |
| 12,059,993 | B1 | 8/2024 | McEligott | |
| 2017/0015497 | A1 | 1/2017 | Diniaco | |
| 2023/0123091 | A1 | 4/2023 | Grant et al. | |

* cited by examiner

*Primary Examiner* — Jason L Vaughan
(74) *Attorney, Agent, or Firm* — The Buche Law Firm, P.C.; Bryce A. Johnson; John K. Buche

(57) ABSTRACT

Disclosed is an improved locking mechanism for shipping containers. In one embodiment, the locking mechanism is integrated into the interbox connector. Specifically, an anti-theft IBC comprises: a body with an upright door barrier, a lever, and a lever insertion hole, an upper shank and a lower shank, where the upper shank and lower shank are configured for coupling the anti-theft IBC to the lower, front, right corner of a shipping container, such that the doors of the shipping container are barred from opening by the upright barrier.

9 Claims, 6 Drawing Sheets

ANTI-THEFT INTERBOX CONNECTOR (IBC) AND RELATED SECURITY METHODS

CROSS-REFERENCE TO RELATED APPLICATIONS

See Application Data Sheet (ADS).

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field locking mechanisms for cargo containers. The field may include integrated security systems for ISO-standard shipping containers, particularly interbox connectors (IBCs) combining vertical stacking functionality with physical door obstruction mechanisms.

Listing of the Prior Art

The following references might be to be related to the disclosed subject matter:

- U.S. Pat. No. 1,675,701 by Fitch (issued Jul. 3, 1928) discloses a freight truck;
- U.S. Pat. No. 3,321,162 by Connerat (issued May 23, 1967) discloses a corner support for containers;
- U.S. Pat. No. 4,265,184 by Cox (issued May 5, 1981) discloses a metal corner board for pallets;
- U.S. Pat. No. 4,854,791 by Brown (issued Aug. 8, 1989) discloses a container door barricade;
- U.S. Pat. No. 5,062,752 by Takaguchi (issued Nov. 5, 1991) discloses a container coupling device;
- U.S. Pat. No. 5,072,845 by Grogan (issued Dec. 17, 1991) discloses a modular cargo container and bottom support member therefore;
- U.S. Pat. No. 6,364,584 by Taylor (issued Apr. 2, 2002) discloses an Access bar for a shipping container;
- U.S. Pat. No. 6,378,917 by Jones (issued Apr. 30, 2002) discloses a door security device with a quickly removable door stop;
- U.S. Pat. No. 6,415,938 by Karpisek (issued Jul. 9, 2002) discloses containers;

- U.S. Pat. No. 7,988,211 by Anderson (issued Aug. 2, 2011) discloses an automatic locking device;
- U.S. Pat. No. 8,240,495 by Ronci et al. (issued Aug. 14, 2012) discloses a container internal lock mechanism;
- U.S. Pat. No. 8,627,971 by Lancaster et al. (issued Jan. 14, 2014) discloses an access shield for shipping container;
- U.S. Pat. No. 12,059,993 by McElligott (issued Aug. 13, 2024) discloses a cargo trailer access door security barrier;
- U.S. Pub. Pat. App. No. 2017/0015497 by Diniaco (published Jan. 19, 2017) discloses a modular construction supply materials container system and method of providing the same; and,
- U.S. Pub. Pat. App. No. 2023/0123091 by Grant et al. (published Apr. 20, 2023) discloses a security barrier for outward swinging doors of vehicles and method thereof.

See the Information Disclosure Statements (IDS) of record.

Background of the Invention

Modern shipping container logistics face persistent challenges in cargo security, with theft during rail or port stacking operations remaining a significant and unresolved problem. The inventor, Michael Garramone, encountered these security issues firsthand during an event at BNSF Railway's Alliance Intermodal Facility, where the scale and frequency of container theft were evident. After reviewing existing solutions such as external door shields (e.g., U.S. Pat. No. 8,627,971) and manual access bars (e.g., U.S. Pat. No. 6,364,584), the inventor identified critical flaws in their design and implementation. For example, U.S. Pat. No. 8,627,971's door shields require manual installation, are prone to user error, and remain vulnerable to defeat by portable cutting tools due to light-weight construction. Likewise, U.S. Pat. No. 6,364,584's bar, while providing some physical obstruction to container doors, relies on sheet metal with lightening holes and must be manually positioned over two locking cleats at once. This makes installation tedious and allows the device to be quickly compromised with basic cutting tools. Both solutions fail to integrate with ISO 1161-compliant intermodal workflows, instead requiring separate security steps that introduce operational delays and create opportunities for unauthorized access.

The inventor's review of these technologies revealed an industry paradox: stakeholders require security solutions that are compatible with crane-based intermodal handling, yet the prior art does not integrate vertical stacking with effective door obstruction. For example, while U.S. Pat. No. 6,364,584's bar can be used on stacked containers, it still requires manual installation, remains accessible for tampering at ground level, and lacks structural integration with ISO corner castings. Similarly, U.S. Pat. No. 8,627,971's shields interfere with crane operations, necessitating manual retrofitting that disrupts transit schedules. These limitations leave stacked containers exposed during high-risk transfer phases, especially at intermodal hubs.

In light of these deficiencies, a challenge exists to find a solution that makes theft "impossible without overhead crane equipment"-remains unmet by existing systems. In other words, there is a clear need in the shipping industry for improved anti-theft systems that eliminate the operational friction of manual security devices and permanent locks, and instead provide embedded, workflow-compatible theft prevention.

SUMMARY OF THE INVENTION

In view of the foregoing, an object of this specification is to disclose an improved locking mechanism for shipping containers that integrates theft prevention directly into intermodal stacking hardware. In one embodiment, the locking mechanism is embedded within an ISO 1161-compliant IBC, combining vertical stacking functionality with physical door obstruction. The anti-theft IBC comprises a body housing an upright door barrier, a recessed lever mechanism, and ISO-compliant upper and lower shanks. These components couple the device to the lower front right corner of a shipping container, physically preventing door opening while maintaining seamless integration with intermodal handling workflows. By unifying crane-dependent security and stacking mechanics, the invention eliminates vulnerabilities inherent in manual solutions like external door shields (U.S. Pat. No. 8,627,971) or tedious access bars (U.S. Pat. No. 6,364,584), which remain susceptible to tampering and operational delays.

The disclosed anti-theft IBC directly addresses the industry's unmet need for a unified system that integrates ISO-compliant vertical stacking with door obstruction requiring crane intervention for removal. Prior solutions force operators to choose between secure stacking and door security, leaving containers exposed during high-risk transit phases. The disclosed anti-theft IBC fills this void by embedding a tamper-resistant barrier within the IBC itself, ensuring security is maintained throughout the intermodal chain without disrupting standard workflows.

In preferred embodiments, the anti-theft IBC system includes: Structural Components (like ISO 1161-compliant upper and lower shanks for secure stacking, a central housing body, and an L-shaped stopper positioned to obstruct container doors); Security Features (like a reinforced barrier constructed from high-strength low-alloy (HSLA) steel, engineered to resist cutting tools and thermal attacks, and a recessed lever mechanism that requires specialized tooling for activation, preventing unauthorized disengagement); and Operational Method (like installation via standard crane operations to engage the anti-theft IBC through the lower front right corner casting, deploying the barrier to block door movement, where removal necessitates vertical lifting using overhead equipment, ensuring security persists until authorized disengagement at the destination).

In a preferred case, the dual functionality (combining ISO-compliant stacking with crane-dependent security) should fulfill the industry's critical need for embedded, workflow-compatible theft prevention. Unlike prior art, the invention eliminates procedural friction by leveraging existing intermodal infrastructure, providing robust protection against theft during rail, port, and storage operations. The integration of security directly into the IBC's structure ensures compatibility with global shipping standards while addressing the operational paradox identified during the inventor's experience at BNSF Railway's Alliance Intermodal Facility.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

In the figures, the following components of the preferred embodiment are shown in connection with the corresponding reference numeral identified below.

- 1000 Anti-theft IBC
  - 1100 upper shank
  - 1200 body
    - 1210 lever
    - 1220 lever insertion hole
    - 1230 upright door barrier
      - 1231 L-shaped stopper
  - 1300 lower shank
- 2000 container
  - 2100 container corner
  - 2200 container door It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Disclosed is an improved locking mechanism for shipping containers that integrates theft prevention directly into intermodal stacking hardware. The anti-theft IBC comprises a body housing an upright door barrier, a recessed lever mechanism, and ISO-compliant upper and lower shanks. The upright door barrier extends vertically from the body and terminates in an L-shaped stopper positioned to obstruct the lower right corner of container doors. The upper and lower shanks are forged from high-strength steel to withstand vertical stacking loads, while the L-shaped stopper-constructed from solid HSLA steel per the inventor's disclosure-resists defeat by portable cutting tools. The device integrates three primary components: a central steel pin with pyramid-shaped shanks, a two-part housing enclosing the pin, and a welded steel rod enabling locking/unlocking via lateral movement.

Figure 1:
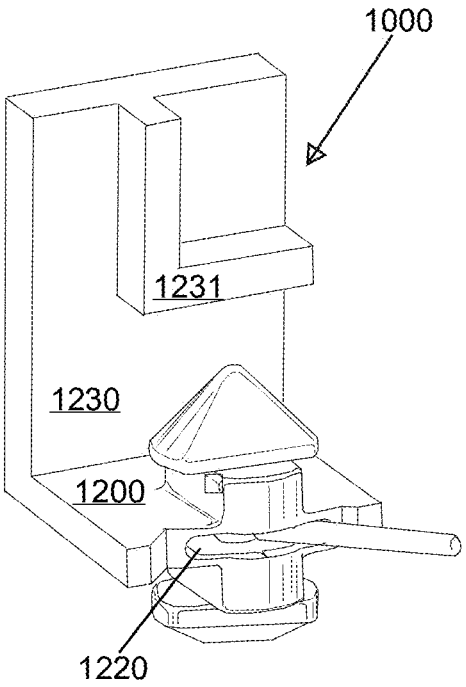
FIG. 1 is a perspective view of an anti-theft IBC.
Figure 12:
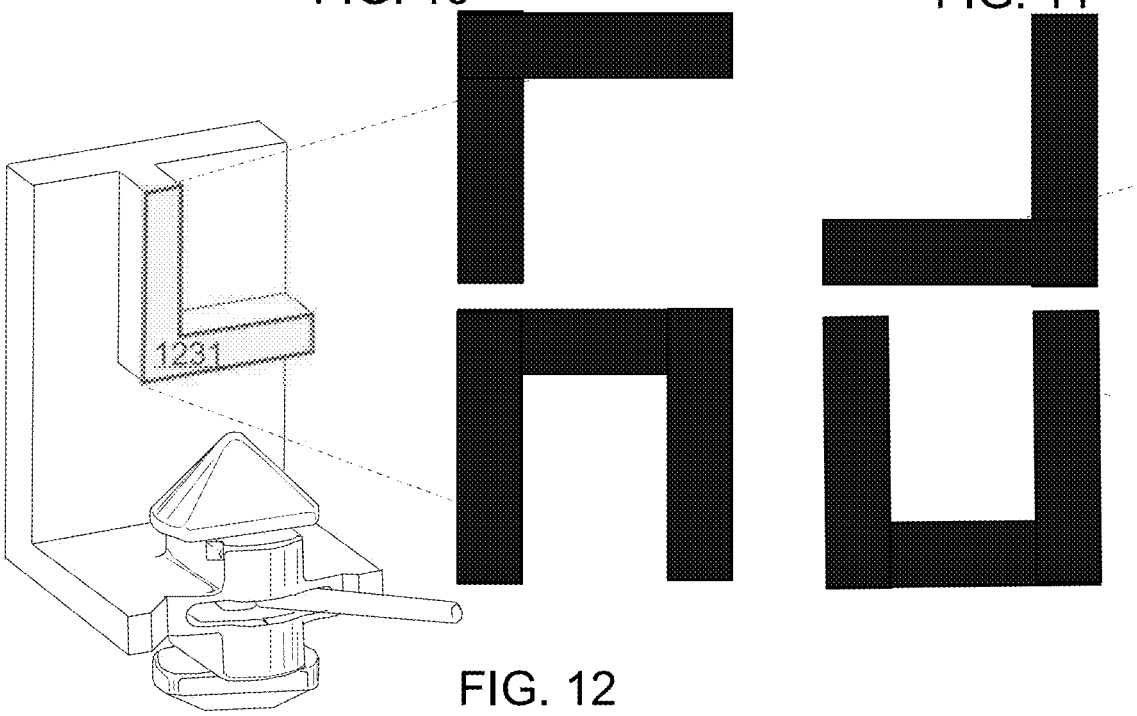
FIG. 12 is a perspective view showing alternate embodiments of the L-shaped stopper, including an upside-down L shape, a mirror-image L shape, a U shape, and an upside-down U shape.

FIG. 1 is a perspective view of an anti-theft IBC. As shown, the anti-theft IBC (1000) comprises a body (1200) with an upper shank (1100) and lower shank (1300) configured for ISO 1161-compliant engagement with container corner castings (2100). The body (1200) integrates a lever (1210) and lever insertion hole (1220) for manual operation of the locking mechanism. A critical feature is the upright door barrier (1230), which extends vertically from the body (1200) and terminates in an L-shaped stopper (1231). The stopper (1231) is positioned to obstruct the lower right corner of container doors (2200) when installed. The upper shank (1100) and lower shank (1300) are forged from high-strength steel to withstand vertical stacking loads exceeding 1200 kN (as required by ISO standards). The "L" shape pictured is designed to engage the point which container door starts above the corner casting on a standard 20 ft, 40 ft, and 45 ft shipping container. Although the "L" shape is depicted, other shapes can suitably be substituted for the "L" shape shown. For example, FIG. 12 shows a perspective view of the anti-theft IBC with alternate embodiments of the L-shaped stopper, including an upside-down L shape, a mirror-image L shape, a U shape, and an upside-down U shape. The upright piece would be solid HSLA steel at 4 in thickness making it far too thick for any portable cutting tools to be effectively utilized to cut away the device. The IBC is otherwise like the standard device used to connect two shipping containers at all four corner castings fully securing them for intermodal transport. The anti-theft IBC itself is comprised of 3 parts: A solid steel pin with a large and small pyramid shape shank at opposite ends that when turned hold the upper and lower corner castings together; The middle housing of the IBC as pictured is made of two halves that hold the pin in place and has an opening for the locking handle. The final part is a simple steel rod that is welded in place to the center pin so that the device can lock and unlock from and left to right movement.

Figure 2:
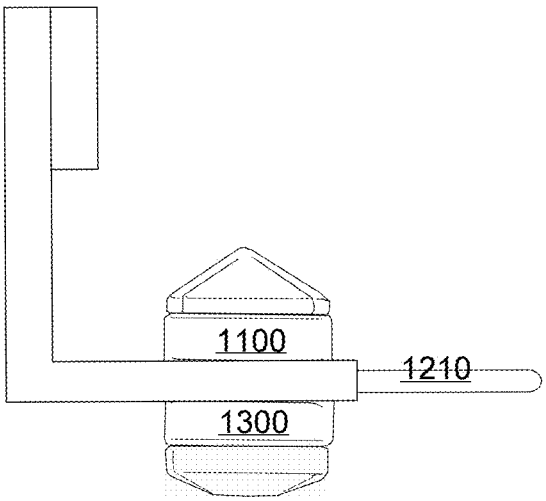
FIG. 2 is a side view thereof.
Figure 4:
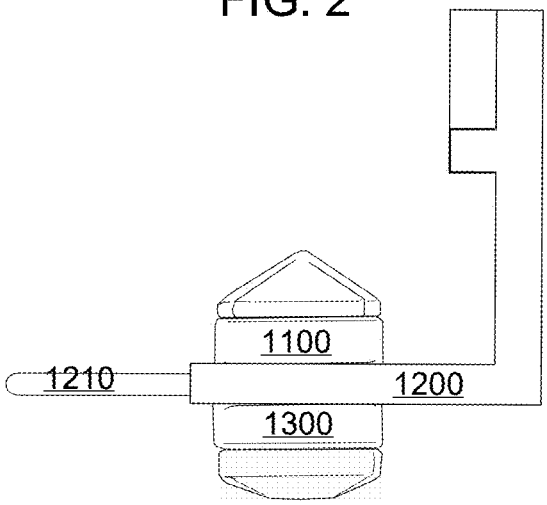
FIG. 4 is another side view thereof.

FIG. 2 is a side view of the Anti-theft IBC (1000). FIG. 4 is an alternate side view thereof the anti-theft IBC (1000). These views highlight the geometric relationship between the upper shank (1100), body (1200), and lower shank (1300). The L-shaped stopper (1231) projects horizontally from the body (1200) and rises vertically to intersect the door swing path. The lever (1210) is shown in its default locked position. These views emphasizes the lower shank (1300) engagement with the ISO corner casting (2100). The upright door barrier (1230) is welded to the body (1200) with full-penetration seams, ensuring rigidity under lateral forces.

Figure 3:
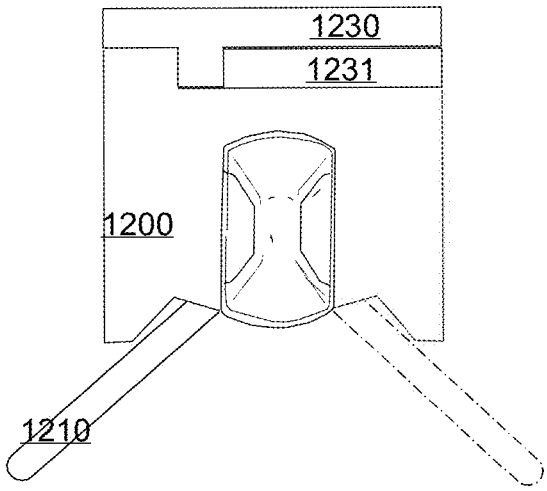
FIG. 3 is a top view thereof.

FIG. 3 is a top view of the anti-theft IBC. The top view reveals the rectangular profile of the body (1200) and the alignment of the lever insertion hole (1220) with the locking mechanism's internal cam. The L-shaped stopper (1231) is offset from the body's longitudinal axis to accommodate standard door handle clearances. Top-view analysis reveals the housing's rectangular profile and the alignment of the lever insertion hole with the internal cam mechanism. The L-shaped stopper is offset from the body's longitudinal axis to accommodate standard door hardware, maintaining unobstructed functionality while preventing unauthorized access.

Figure 5:
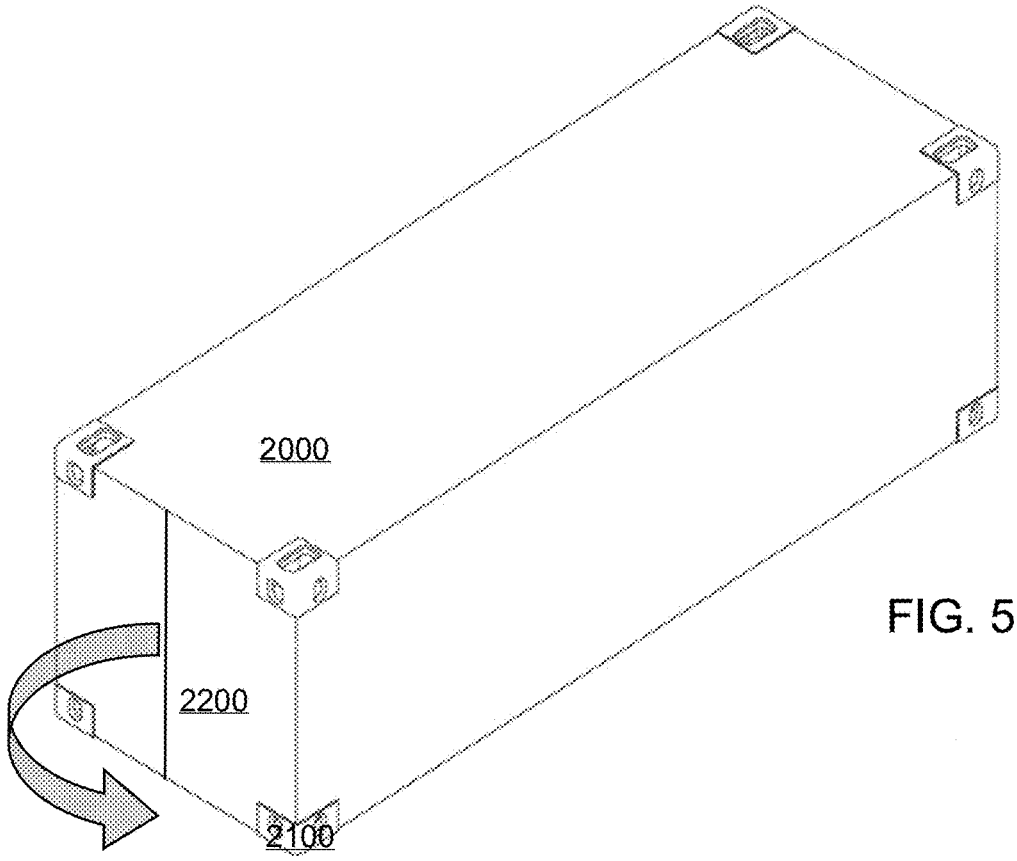
FIG. 5 is perspective view of a shipping container with outwardly opening doors.
Figure 6:
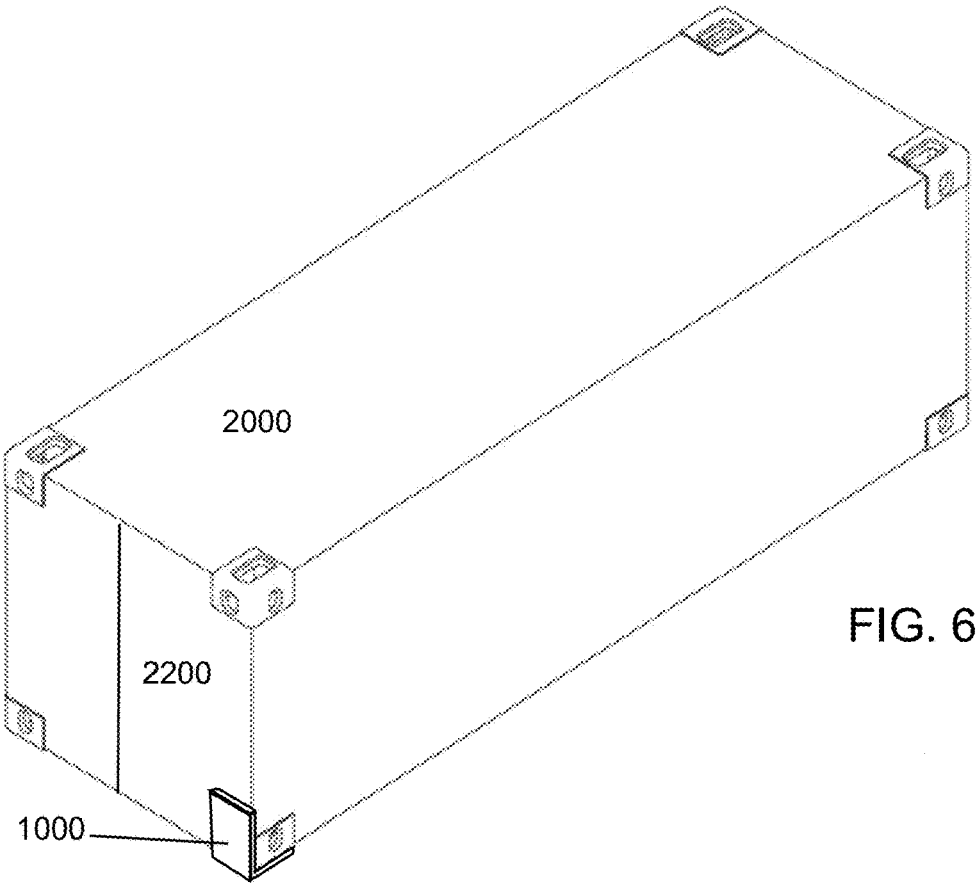
FIG. 6 is a perspective view of the shipping container of FIG. 5 with an anti-theft IBC installed on the lower, front right corner of the container.

FIG. 5 is perspective view of a shipping container with outwardly opening doors. FIG. 6 is a perspective view of the shipping container of FIG. 5 with an anti-theft IBC installed on the lower, front right corner of the container. A standard ISO container (2000) is depicted with doors (2200) in the closed position. The container corner (2100) is shown with its characteristic oval aperture for IBC engagement. The door's lower right corner aligns with the intended obstruction zone of the L-shaped stopper (1231). In FIG. 6, the anti-theft IBC (1000) is fully seated in the container corner (2100), with the L-shaped stopper (1231) positioned below the door's pivot axis. The stopper (1231) blocks the door's swing arc, rendering manual opening impossible without vertical disengagement via crane.

Figure 7:
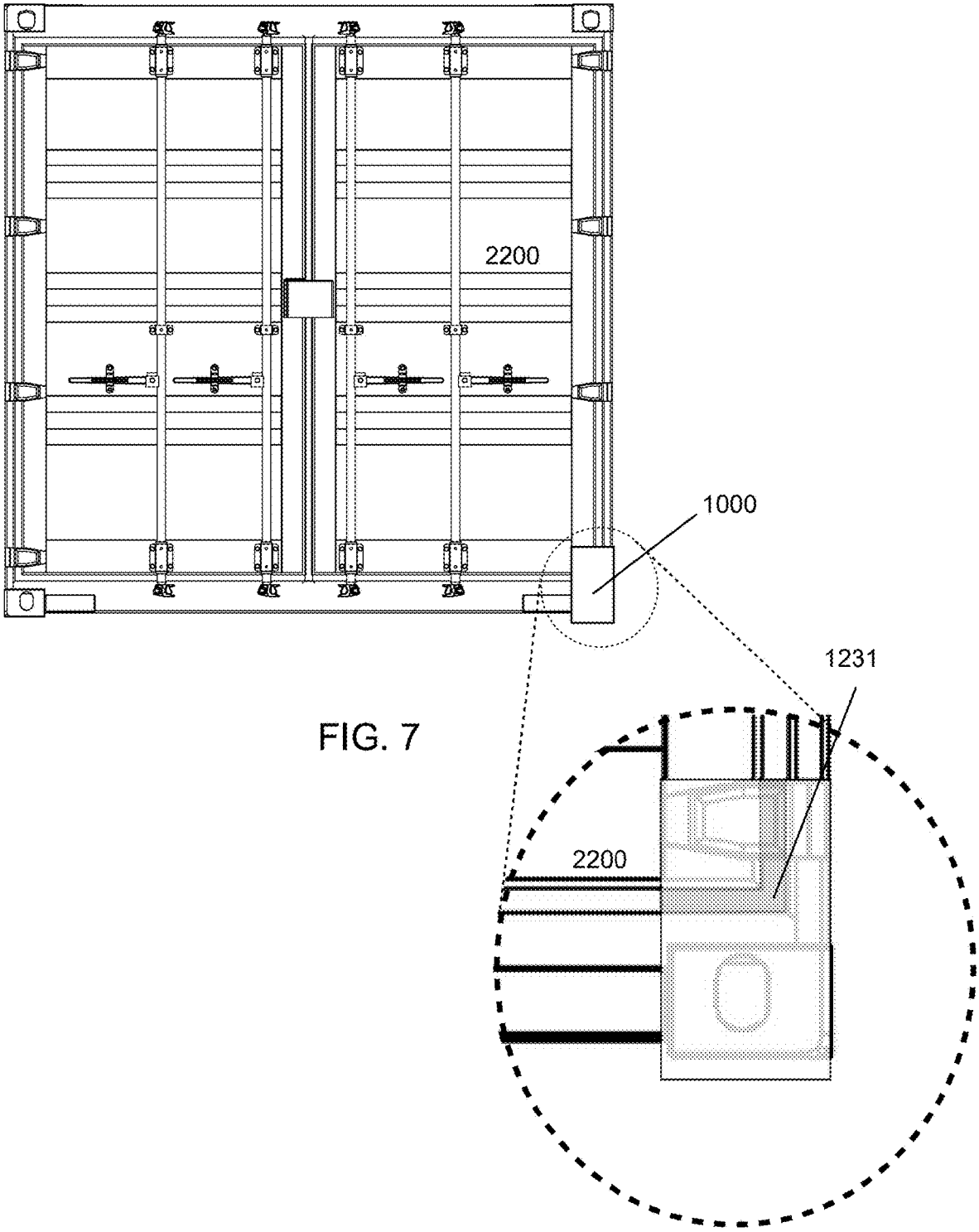
FIG. 7 is a zoom-in view of the lower, front right corner of the container.

FIG. 7 is a zoom-in view of the lower, front right corner of the container. Detailed close-up shows the L-shaped stopper (1231) interfacing with the door's lower right corner (2200). The stopper's vertical face is configured to resist cutting tools, while its horizontal extension prevents prying attacks. The lever (1210) is recessed to deter tampering. When installed on a shipping container, the anti-theft IBC positions the L-shaped stopper below the door's pivot axis, blocking a significant portion of the door's swing arc. This configuration renders manual door opening impossible without vertical disengagement via crane. Close inspection of the installed device shows the L-shaped stopper interfacing with the container door's lower right corner. The stopper's vertical face incorporates anti-tamper features to resist cutting and prying attacks, while the recessed lever design deters unauthorized manipulation.

Implementation

The IBC (1000) integrates with standard corner castings (2100) through forged steel shanks (1100/1300). The IBC integrates with standard corner castings through forged steel shanks, ensuring compatibility with global intermodal infrastructure. The L-shaped stopper's projection is calibrated to obstruct container doors across 20 ft, 40 ft, and 45 ft configurations without requiring manual adjustment.

Material Specifications

Materials that might be used include HSLA steel. Suitably, the device may include full-penetration welds at barrier-body junction. In some embodiments, saltwater-resistant epoxy coatings are used. In other words, material selection prioritizes HSLA steel for all structural components, as explicitly disclosed by the inventor. A marine-grade epoxy coating provides corrosion resistance for maritime and port environments.

Figure 8:
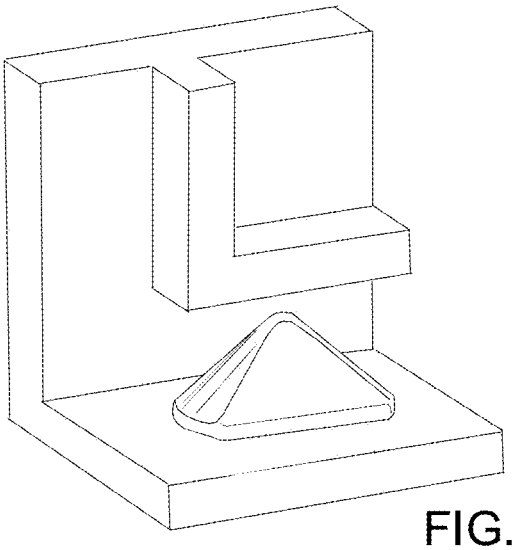
FIG. 8 is a perspective view of an alternate embodiment of an anti-theft IBC.
Figure 9:
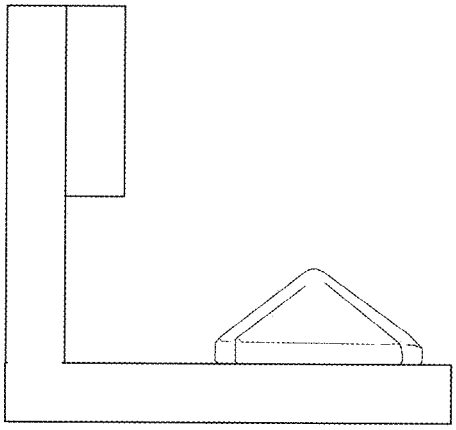
FIG. 9 is a side view thereof.
Figure 10:
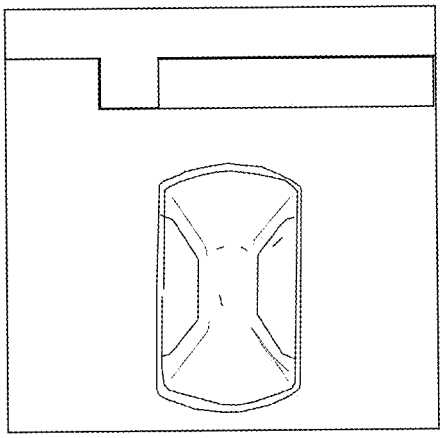
FIG. 10 is a top view thereof.
Figure 11:
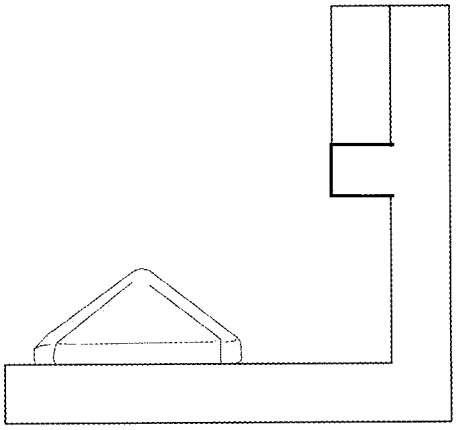
FIG. 11 is another side view thereof.

FIG. 8 is a perspective view of an alternate embodiment of an anti-theft IBC. FIGS. 9 through 11 are respectively a side view, top view, and another side view thereof. Suitably, this version represents a modified IBC design (relative to FIGS. 1 through 4) for 53-foot containers features a sliding upper shank (1100) to accommodate intermediate corner castings. This variation connects via the front right corner but must sit flush on top only "locking" in place from the top container. This follows the same principles of the previous Standard ISO connections but will require some minor engineering with a slide that allows the center pin and lock to move left to right a few inches while locking to accommodate the minor variations in hole from brand to brand. This alternate embodiment for 53-foot domestic containers incorporates a sliding upper shank mechanism to accommodate variations in corner casting positions across manufacturers. This adaptation maintains the core security principles of crane-dependent disengagement while addressing brand-specific dimensional tolerances.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus, the breadth and scope of the claimed invention should not be limited by any of the above-described embodiments. This 53-Foot Container Adaptation includes: Sliding upper shank accommodates variable casting positions; and, Dual locking pins for brand-specific hole tolerances.

Method of Use for the Anti-Theft IBC

The anti-theft IBC's operational method leverages existing intermodal workflows: installation occurs during standard crane stacking procedures, with security activation requiring a specialized tool to engage the recessed lever. Removal necessitates vertical lifting via overhead equipment, ensuring persistent theft prevention throughout transit. Field validation confirmed the system's resistance to cutting tools and thermal attacks due to its HSLA steel construction.

The method of use for the anti-theft IBC focuses on securing shipping containers during intermodal transit to prevent the $1 billion annual losses from cargo theft as reported by the Transportation Security Council. The implementation process begins with identifying the lower front right corner casting of the target shipping container, ensuring full ISO 1161 compliance of the aperture. This specific location is critical as it positions the upright door barrier precisely where it can obstruct the container doors from opening when properly installed.

The installation requires overhead crane equipment typically found at intermodal facilities, ports, and rail yards. The operator must position the container for proper IBC insertion, typically during the standard loading process when containers are being stacked. The anti-theft IBC is then aligned with the corner casting apertures, with the upper shank positioned to enter the upper container's corner casting and the lower shank inserted into the target container's corner casting. This insertion follows standard industry practice for conventional IBCs but provides the additional security function.

After physical insertion, the operator engages the security mechanism by inserting a specialized tool into the lever insertion hole (1220) and rotating the lever (1210) to activate and deploy the vertical barrier (1230). This critical step positions the L-shaped stopper (1231) to intersect the door's potential swing arc, making it physically impossible to open the container doors while the device remains in place. The recessed design of the lever mechanism prevents unauthorized tampering when installed.

Security verification must be performed before transport by confirming the upright door barrier is positioned below the door's pivot axis and that the L-shaped stopper effectively blocks the container door (2200) from opening. The 4-inch thick HSLA steel construction ensures the barrier resists defeat attempts using portable cutting tools or torches commonly employed by container thieves.

Removal of the anti-theft IBC necessarily requires vertical lifting via overhead crane equipment, as the device can only be disengaged when the upper container is lifted from the lower container. This requirement ensures that theft prevention remains effective throughout the entire transit chain including rail transport and port storage until authorized personnel with appropriate equipment can access the container at its final destination. This crane-dependent security feature represents the core innovation of the system, making it "impossible" to remove without the specific equipment typically available only at authorized facilities.

Method of Manufacturing the Anti-Theft IBC

Manufacturing processes emphasize structural integrity and tamper resistance. The HSLA steel barrier is fabricated as a unified component, welded to the housing body to create an inseparable security structure. For 53-foot container adaptations, sliding mechanisms are precision-engineered to maintain secure engagement across variable casting positions. Final assembly includes quality control verification of weld integrity, lever functionality, and coating uniformity to ensure reliability in intermodal operations.

The manufacturing method for producing the anti-theft IBC employs specialized industrial processes to ensure both structural integrity and robust security functionality. The process begins with material selection, specifically sourcing high-strength low-alloy (HSLA) steel with minimum yield strength of 500 MPa for all primary components. This specific material provides essential strength to withstand both vertical stacking loads exceeding 1200 kN and resist tampering attempts through physical attack.

The upper shank (1100) and lower shank (1300) are precision forged from solid steel, creating the distinctive pyramid shapes at opposite ends that engage securely with standard ISO corner castings (2100). These components require relatively precise machining to ensure proper fit with ISO 1161 corner castings while preventing play that could compromise security. The central housing body (1200) is manufactured in two halves that will later enclose the internal locking mechanism and provide mounting points for the security features.

The critical upright door barrier (1230) component is fabricated from 4-inch thick HSLA steel plate, precisely cut to create both the vertical barrier extending from the housing body and the integrated L-shaped stopper (1231). This thickness dimension is not arbitrary but specifically selected as it exceeds the cutting capacity of portable power tools available to potential thieves. The cutting process must maintain tight tolerances to ensure the barrier will properly obstruct container doors across various container sizes (20 ft, 40 ft, and 45 ft containers) with their slightly different door geometries.

Assembly begins by integrating the central pin component with a welded steel rod that serves as the lever mechanism (1210), allowing the device to lock and unlock through left-to-right movement. The two halves of the central housing are then joined around this assembly using four high-strength bolts positioned above and below the lever section. The upright door barrier is permanently attached to the body using full-penetration welds at multiple stress points, creating a rigid, tamper-resistant security structure that functions as a unified component.

For the 53-foot container adaptation, additional manufacturing steps include incorporating a sliding mechanism into the upper shank design to accommodate variable casting positions found in domestic containers from different manufacturers such as J. B. Hunt, Amazon, and Hapag-Lloyd. This sliding mechanism allows the center pin and lock to move laterally several inches while maintaining secure locking capability, accommodating the minor variations in corner casting positions across different container brands.

Final production stages include applying a marine-grade saltwater-resistant epoxy coating to all components, providing necessary corrosion protection for long-term deployment in port environments and open-sea transport conditions. Each unit undergoes quality control inspection verifying dimensional accuracy, weld integrity, lever operation, and coating uniformity before certification for deployment in intermodal shipping operations, ensuring both functional reliability and security effectiveness throughout the product lifecycle.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, diagrams and their accompanying description should not be construed as mandating a particular architecture or configuration.

Figure 13:
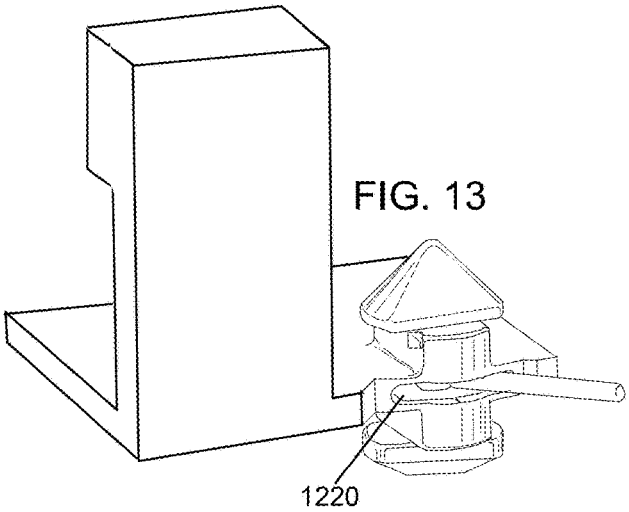
FIG. 13 is a perspective view of another embodiment of an anti-theft IBC.
Figure 14:
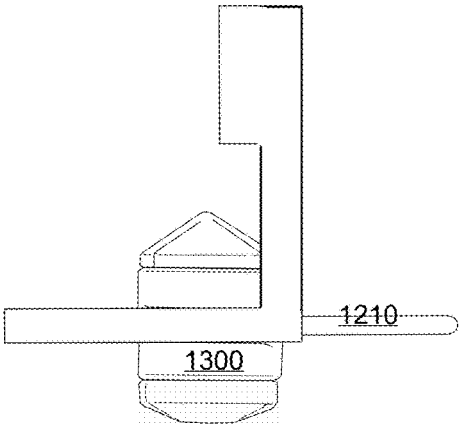
FIG. 14 is a side view thereof.
Figure 15:
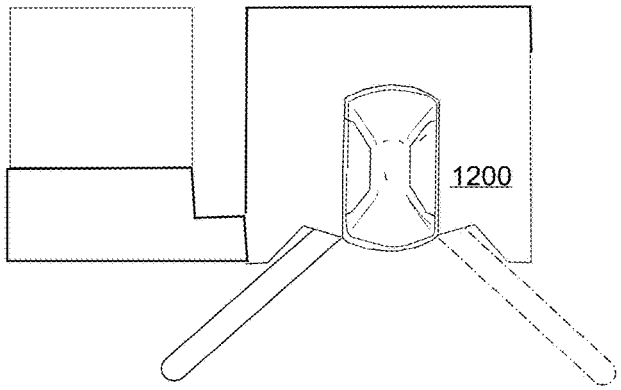
FIG. 15 is a top view thereof.
Figure 16:
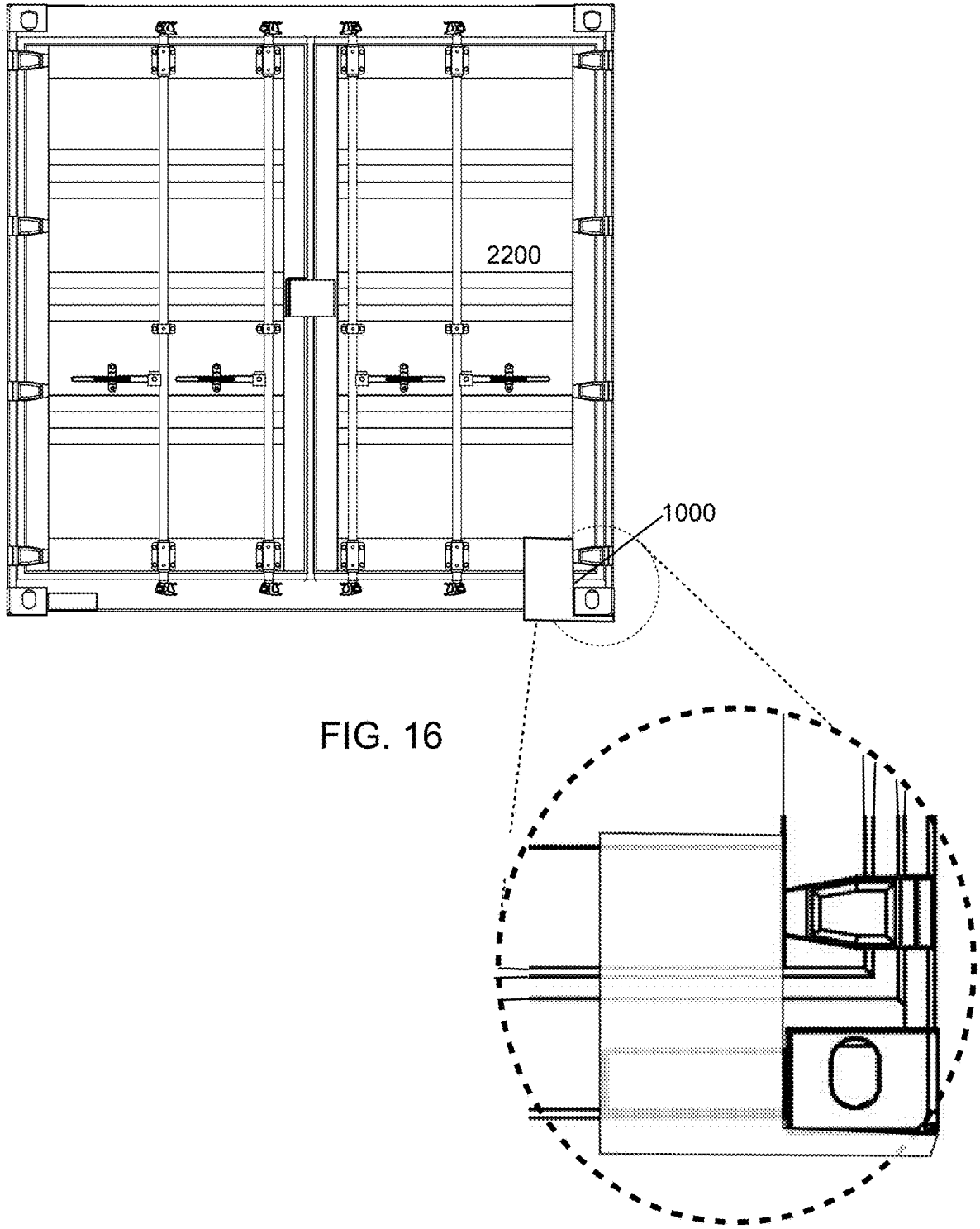
FIG. 16 is a zoom-in view of the lower, front right corner of a container.

Additionally, alternate configurations of the anti-theft IBC 1000 are possible. For instance, FIG. 13 is a perspective view of another embodiment of an anti-theft IBC 1000. FIGS. 14 and 15 are respectively a side view and top view of this alternate version. As shown, the upright is off-center of the IBC components. Suitably, as illustrated in FIG. 16, the off-center portion of the anti-theft IBC fills the fork-lift cutout of the container with its horizontal projection and features the upright portion that bocks door opening as in the earlier version of the device. As with the earlier version, the upright features a projection, including L or U shapes as described above (see FIG. 12). This alternative embodiment could feature cleats like those shown in FIGS. 8-11. Other adaptations are contemplated and would be within the scope and spirit of the present disclosure.

All original claims submitted with this specification are incorporated by reference in their entirety as if fully set forth herein.

I claim:

1. A method of securing at least one door of a shipping container during intermodal transport, comprising:

a) engaging an anti-theft interbox connector (IBC) through a lower front right corner casting of the shipping container, wherein the IBC features a recessed lever mechanism;

b) activating the recessed lever mechanism to deploy an upright door barrier;

c) requiring vertical lifting of the shipping container via overhead crane equipment to disengage said IBC;

wherein said upright door barrier blocks the at least one door of the shipping container from opening until crane lifting of the shipping container.

2. The method of claim 1 wherein:

the IBC comprises:

a) upper and lower engagement shanks;

b) a central housing body connecting said shanks via a central pin enclosed by the housing;

c) an upright door barrier extending vertically relative to said housing body;

d) a stopper integrally formed with said upright door barrier;

wherein said stopper is positioned to obstruct the at least one door of the shipping container when said IBC is engaged with a corner casting of the shipping container.

3. The method of claim 2, further comprising:

a recessed lever mechanism operable only when said upper and lower shanks are disengaged from coner castings.

4. The method of claim 3, wherein:

said upright door barrier comprises high-strength low-alloy (HSLA) steel.

5. The method of claim 3, wherein:

said HSLA steel has a thickness exceeding the cutting capacity of portable power tools.

6. The method of claim 5, further comprising:

a marine-grade epoxy coating applied to all exterior surfaces.

7. The method of claim 6, wherein:

the stopper is L-shaped and said L-shaped stopper is positioned below a container door's pivot axis when installed.

8. The method of claim 1, further comprising:

verifying upright door barrier positioning below a pivot axis of the at least one door after activation.

9. The method of claim 1, wherein:

disengagement requires simultaneous vertical separation of the shipping container and another shipping container that is stacked underneath the shipping container.

* * * * *